United States Patent [19]

Anstead

[11] Patent Number: 4,747,243

[45] Date of Patent: May 31, 1988

[54] COLLAPSIBLE PORCH

[76] Inventor: Kenneth L. Anstead, 190 Green Acres Dr., Anderson, Calif. 96007

[21] Appl. No.: 44,749

[22] Filed: May 1, 1987

[51] Int. Cl.[4] ..... E04B 1/343

[52] U.S. Cl. ..... 52/184; 52/79.6; 52/182; 52/645

[58] Field of Search ..... 52/79.6, 645, 646, 182, 52/183, 184

[56] References Cited

U.S. PATENT DOCUMENTS

| | | | |
|---|---|---|---|
| 631,465 | 8/1899 | Hock . | |
| 2,681,841 | 6/1954 | Sperry . | |
| 2,842,408 | 7/1958 | Symons | 52/645 |
| 3,296,983 | 1/1967 | Brush . | |
| 3,352,312 | 11/1967 | Martin . | |
| 3,788,016 | 1/1974 | Richardson | 52/183 |
| 3,808,757 | 5/1974 | Greenwood | 52/79.6 X |
| 3,878,797 | 4/1975 | Patterson . | |
| 3,906,690 | 9/1975 | Miriani | 52/184 |
| 4,074,475 | 2/1978 | Wahlquist | 52/79.6 X |
| 4,150,630 | 4/1979 | Pokorny et al. . | |
| 4,413,855 | 11/1983 | Flanagan | 52/79.6 X |
| 4,468,901 | 9/1984 | Henderson et al. | 52/79.6 |
| 4,527,362 | 7/1985 | Tobey et al. | 52/646 X |
| 4,580,776 | 4/1986 | Burkinshaw . | |

*Primary Examiner*—Alfred C. Perham
*Attorney, Agent, or Firm*—Leonard D. Schappert

[57] ABSTRACT

A portable collapsible porch is provided for use with campers, camping trailers and the like which includes a foldable platform structure and collapsible legs, stairway and protective rail structure, thereby requiring minimal space for storage and transportation, and further includes adjustable legs to facilitate use in uneven terrain.

10 Claims, 2 Drawing Sheets

COLLAPSIBLE PORCH

BACKGROUND OF THE INVENTION

1. Field of the Invention

This invention relates generally to portable decks and porches, and more specifically to collapsible porches and decks which, while they include the means for holding them sturdy and stable when set up as a porch or deck, also include means for collapsing them so as to create a very neat and compact package which requires a relatively small area for storage.

2. Description of the Prior Art

Past inventions have included collapsible stages, collapsible camping units and collapsible tables, each designed for different purposes and each designed to provide a compact, collapsible unit. While inventors in the past have directed their efforts toward creating collapsible units which might be easily stored, none of the prior art of which applicant is aware has taught a collapsible porch or deck having the unique features as taught by the present invention

SUMMARY OF THE INVENTION

The present invention consists of a collapsible porch having a platform which includes a surface which is easily removed and a frame structure which collapses into a small area for compact storage. The collapsible porch further includes legs, rails and a stair system, each collapsible but extremely sturdy when fully assembled. The collapsible porch includes adjustability to allow adjustment to different heights and individually adjustable feet and legs so that the collapsible porch can be adjusted to the terrain when used on uneven ground.

One of the objects of the present invention is to provide a collapsible porch which is easily assembled without the use of an excessive number of tools and which, when properly assembled, provides an extremely stable porch for use with campers, camping trailers and the like.

Anotner object of the present invention is to provide a collapsible porch which can be folded into an extremely compact unit so that it can be stored in a small area and transported in a camper, camping trailer or the like without undue restriction of the movement of the individuals utilizing the camper or camping trailer.

A further object of the present invention is to provide a collapsible porch which includes means for adjusting its legs to match different terrains.

Another object of the present invention is to provide a collapsible porch which, because of its unique rail arrangement, facilitates the stable positioning of the stairs and rails to provide ingress and egress parallel or perpendicular to the camper or camping trailer with which it is being used.

The foregoing objects, as well as other objects and benefits of the present invention, are made more apparent by the descriptions and claims which follow.

BRIEF DESCRIPTION OF THE DRAWINGS

FIG. 1 is a perspective view of the collapsible porch showing its structure and how it is utilized with a camper, camping trailer or the like.

DESCRIPTION OF THE PREFERRED EMBODIMENT

Figure 1:
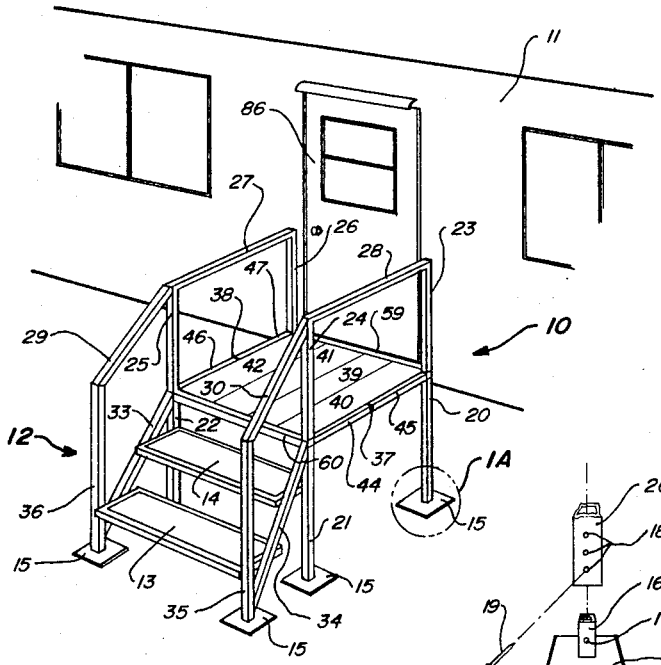
Figure 1A:
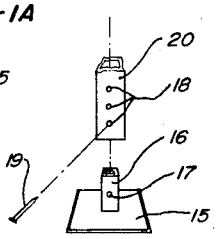
FIG. 1A is an expanded, exploded view of the encircled area designated lA in FIG. 1 showing the method of connecting and adjusting the feet to adjust the length of the legs.

FIG. 1 of the drawings is a perspective view of the collapsible porch 10 showing it positioned against door 86 for use with living quarters 11 consisting generally of a camper or camping trailer or the like. Specifically, collapsible porch 10 includes a platform and leg structure which includes rods 59 and 60, rods 44 and 45, which are hinged together by hinge 37, and rods 46 and 47, which are hinged together by hinge 38. Legs 20, 21, 22 and another leg 52, not shown in FIG. 1, are attached to the platform and leg structure 85 to support it in an upright position as shown in FIG. 1. A floor section consisting of floor pieces 39 and 4 and a floor section consisting of floor pieces 41 and 42, each constructed of metal or wood sheeting or comparable materials, are positioned atop the platform and leg structure 85 to create a solid floor. Rails 27 and 28 are provided to ensure safety of individuals using the collapsible porch 10 and are attached to the platform and leg structure 85 by rods 25 and 26 and rods 23 and 24 respectively. A stairway section 12 consisting of tread units 13 and 14 attached to rods 33 and 34 and legs 35 and 36, together with stair rails 29 and 30, is attached to the platform and leg structure 85 as shown. Feet 15 are provided at the base of each of legs 20, 21, 22, 35, 36 and 52 to provide a stable base of support for the collapsible porch 10. FIG. lA, which is an expanded view of the encircled area lA of FIG. 1, shows the attachment of foot 15 to leg 20. Foot 15 includes an upright extension 16 which fits inside leg 20, which is generally structured of hollow rod and is attached to leg 20 by pin 19, which extends through one of holes 18 in leg 20 and hole 17 in extension 16 to attach foot 15 to leg 20. Construction of the leg and foot arrangement of FIG. lA is typical of each of legs 20, 21, 22, 35, 36 and 52 with feet 15. The units used to create the floor of collapsible porch 10 are shown in FIG. lB. Two floor units are utilized: a floor unit consisting of floor pieces 39 and 40, hinged together by hinges 80, and a second floor unit consisting of floor pieces 41 and 42, hinged together by hinges 80, are positioned on rods 44, 45, 46, 47, 59 and 60 to form the floor of collapsible porch 10.

Figure 2:
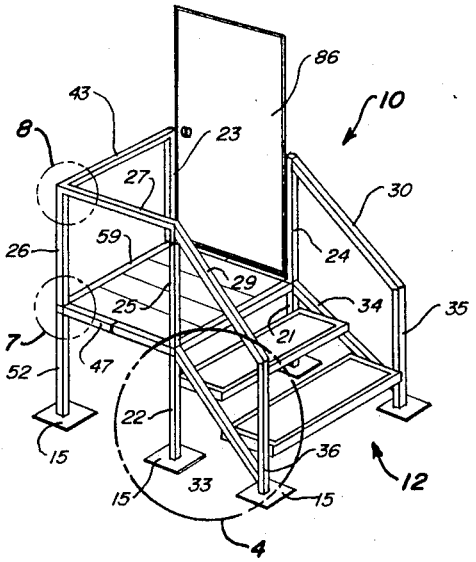
FIG. 2 is a perspective view showing the collapsible porch oriented differently with respect to the door of a camper or camping trailer.
Figure 1B:
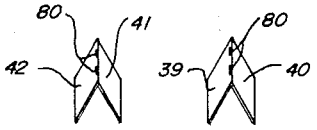
FIG. 1B shows the foldable floor unit for use with the collapsible porch.

FIG. 2 of the drawings shows collapsible porch 10 of FIG. 1 in a different configuration, positioned so that it provides ingress and egress parallel to door 86 of living quarters 11. Collapsible porch 10 is here turned 90 degrees, but rail 28 has been removed so that collapsible porch 10 interfaces properly with door 86, and rail 43 has been positioned between rods 23 and 26 to ensure safety. The positioning of leg 52 is also shown in FIG. 2, and the stairway construction is further illustrated.

Figure 3:
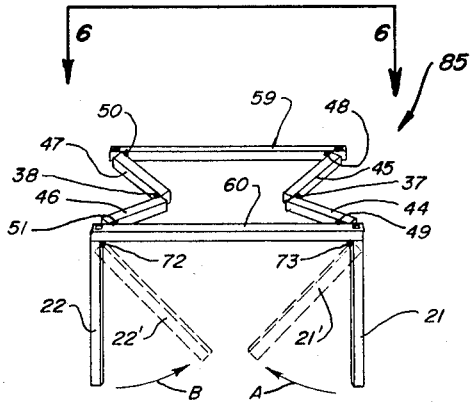
FIG. 3 is a perspective view showing the frame structure of the platform and leg sections of the collapsible porch and showing the movements involved in folding the and leg structure.
Figure 6:
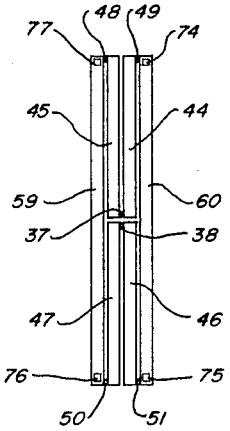
FIG. 6 is a top view of the platform and leg structure of the collapsible porch taken along lines 6—6 of FIG. 3 and showing the platform structure in fully folded position.

FIG. 3 is a perspective view of the platform and leg structure 85 of collapsible porch 10. Rods 59 and 60 are substantially rigid, but are attached together by the combination of rods 46 and 47 and rods 44 and 45 to form a collapsible unit. Rod 45 is attached to rod 59 by hinge 48, and to rod 44 by hinge 37. Rod 44 is attached to rod 60 by hinge 49. Rod 47 is attached to rod 59 by hinge 50, and to rod 46 by hinge 38. Rod 46 is attached to rod 60 by hinge 51. Thus, as hinges 38 and 37 are pushed toward each other as shown in FIG. 3, rods 59 and 60 are pulled together, ultimately folding into a compact unit as shown in FIG. 6 of the drawings. In order to further increase the ease of storage of collapsible porch 10, legs 21 and 22 are attached to rod 60 by hinges 73 and 72 respectively so that they fold along arrows A and B to the position shown as 21′ and 22′, and ultimately up against the bottom surface of rod 60. Legs 52 and 20 are similarly attached to rod 59 so that they fold up against the bottom surface of rod 59 to make a compact, foldable unit.

Figure 4:
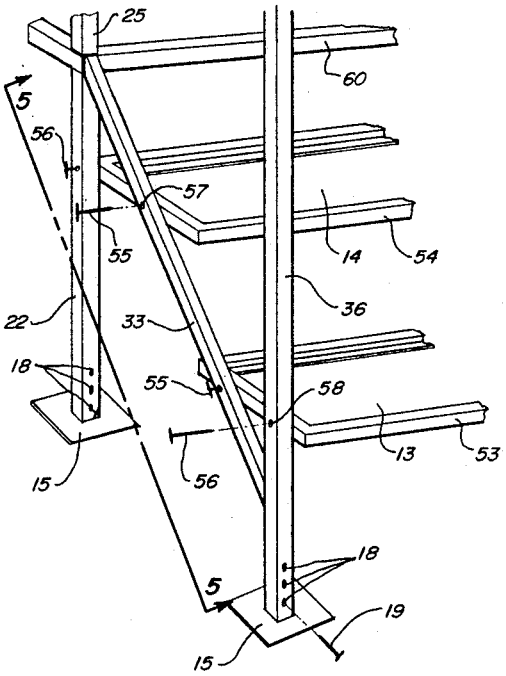
FIG. 4 is an expanded perspective view of the encircled area 4 of FIG. 2 showing the structure of the stairway portion of the collapsible porch.

FIG. 4 is an expanded perspective view of the encircled area 4 of FIG. 2. The tread units 13 and 14 of the stairway section 12 of collapsible porch 10 are positioned atop stair tread frames 53 and 54. Stair tread frame 53 is attached to leg 36 by pin 56, which extends through holes 58 of leg 36 into stair tread frame 53, and to rod 33 by pin 55, which extends through a hole in rod 33 and into stair tread frame 53. Stair tread frame 54 is held in position by pin 55, which extends through hole 57 of rod 33 into stair tread frame 54, and pin 56, which extends through a hole in leg 22 and into stair tread frame 54 to hold it rigid during use. Feet 15, which are attached to legs 22 and 36 by pins 19, are adjustable by the positioning of pin 19 in the desired holes 18, which allows vertical positioning of feet 15 with respect to the bottom of legs 22 and 36. With the stair tread frames 53 and 54 and the rest of the stairway section 12 installed together as a unit, the stairway section 12 is attached to the platform and leg structure 85 and the rail structure of collapsible porch 10. The attachment of the stairway section 12 to the rest of the structure of collapsible porch 10 is shown more clearly in FIG. 5 of the drawings.

Figure 5:
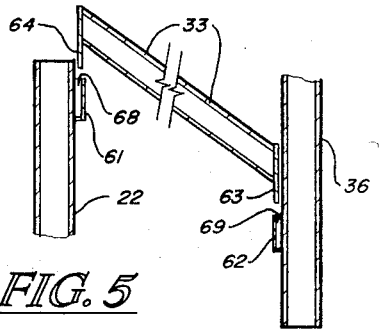
FIG. 5 is a cross-sectional view taken from the perspective of lines 5—5 of FIG. 4 showing the structure employed in attaching the stairway portion of the collapsible porch to the platform and leg structure of the collapsible porch.

FIG. 5 is a cross-sectional view of a portion of the stairway section of collapsible porch 10 taken along lines 5—5 of FIG. 4, but with part of rod 33 cut out. The attachment of rod 33 to leg 36 and leg 22 is typical of the installation of stair rails 29 and 30 to rods 24 and 25 and legs 35 and 36, and the attachment of rod 34 to leg 21 and leg 35. Specifically, rod 33, which extends between leg 22 and leg 36, includes extensions 63 and 64 on its ends. Leg 22 has a receptacle 61 with a hole 68 therein, and leg 36 has a receptacle 62 with a hole 69 therein. With rod 33 positioned as shown in FIG. 5 above receptacles 61 and 62, extensions 63 and 64 of rod 33 can be slid into holes 68 and 69 of receptacles 61 and 62 respectively. Once in position, legs 22 and 36 are held substantially rigidly with respect to each other.

FIG. 6 of the drawings is a top view of platform and leg structure 85 taken along lines 6—6 of FIG. 3, but in a fully folded position. Rods 44 and 45 fold on hinge 37 to be substantially flush against each other, and fold on hinges 48 and 49 to be substantially flush against rods 59 and 60. Rods 46 and 47 fold on hinge 38 to be substantially flush against each other, and on hinges 50 and 51 to be substantially flush against rods 59 and 60. When folded as here shown, and with legs 20, 21, 22 and 52 folded against the bottom surfaces of rods 59 and 60, platform and leg structure 85 forms a substantially rectangular compact unit ready for storage. Rods 59 and 60 include holes 74, 75, 76 and 77 positioned therein and extending therethrough so that, when legs 20, 21, 22 and 52 are constructed of hollow rod as is shown in FIG. 7 of the drawings, the rods 23, 24, 25 and 26, which are utilized to support rails 27, 28 and/or 43, slide through holes 74, 75, 76 and 77 into the interior of the legs 20, 21, 22 and 52, increasing the structural integrity of collapsible porch 10.

Figure 7:
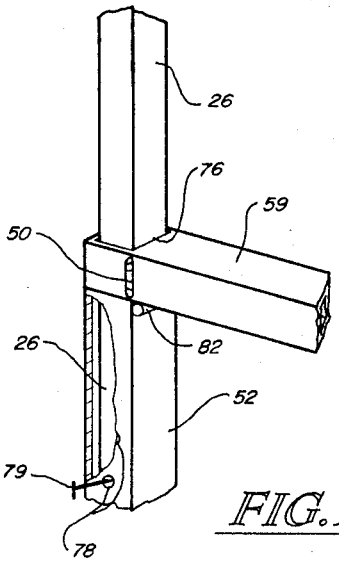
FIG. 7 is an expanded view of the encircled area 7 of FIG. 2 showing how the rail structure attaches to the platform and leg structure of the collapsible porch.

FIG. 7 is an expanded view of the encircled area 7 of FIG. 2 more clearly showing how rod 26 attaches to leg 52. Specifically, rod 26 slides through hole 76 in rod 59 and into the hollow interior of leg 52 to substantially rigidly position rod 26 and leg 52 with respect to rod 59. The extension of rod 26 through hole 76 in rod 59 and into leg 52 minimizes the likelihood that leg 52 will fold on hinge 82 against rod 59 at an inopportune time. Rod 26 is held in vertical position by the extension of pin 79 through one of holes 78. Thus, rod 26 butts against pin 79. Multiple holes 78 are provided to facilitate vertical adjustment of rod 26 and the entire hand rail system used with collapsible porch 10. The structure of rod 26 and leg 52 is typical for each of the rods 23, 24, 25 and 26 and each of the legs 20, 21, 22 and 52. While the attachment of rod 47 to rod 59 is not shown, the positioning of hinge 50 to allow attachment of rod 47 is shown.

Figure 8:
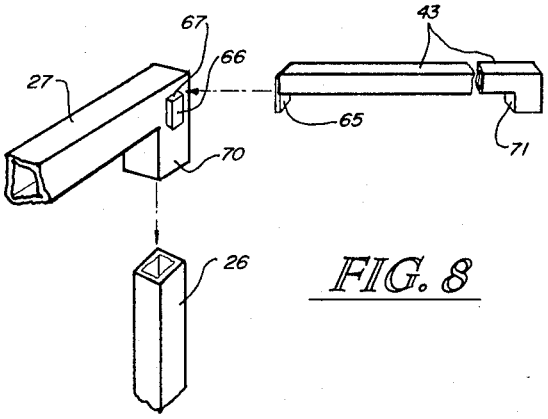
FIG. 8 is an expanded assembly view of the encircled area 8 of FIG. 2 showing how the rail structure is assembled and positioned with respect to the platform and leg structure of the collapsible porch.

FIG. 8 of the drawings is an expanded assembly view of encircled area 8 of FIG. 2. Rail 27 includes a hollow receptacle 70 designed to mate with rod 26 to hold rail 27 securely in position with respect to rod 26, but rail 27 further includes a receptacle 66 with a hole 67 therein attached to the side of rail 27. While such is not specifically shown in this view, rail 27, as well as rail 28, has a second hollow receptacle 70 positioned at the end opposite that shown here so that, when rail 27 is positioned, receptacle 70 and a substantially identical receptacle at the opposite end mate with rods 25 and 26 to position rail 27 as shown in FIG. 1 of the drawings. The structure of rail 28 is substantially identical to that of rail 27 except for receptacle 66, which is not included on rail 28. A special rail 43 is provided for use when collapsible porch 10 is oriented as shown in FIG. 2 of the drawings. In this circumstance, because rail 28 is not usable in the position in which rail 43 is utilized in FIG. 2, rail 43, which includes an extension 65 designed to fit into hole 67 of receptacle 66, is provided. A receptacle 71, substantially identical to receptacle 70, is provided and mates with upright rod 23 in substantially the same manner as that in which receptacle 70 mates with rod 26.

While the rods and rails here utilized are constructed generally of hollow metal rod, and while specific means of attaching parts to one another are here disclosed, any acceptable material and/or means of attachment can be used to accomplish construction of the collapsible porch 10.

Although the foregoing description of the invention has shown a preferred embodiment using specific terms, such description is presented for illustrative purposes only. It is applicant's intention that changes and variations may be made without departure from the spirit or scope of the following claims, and this disclosure is not intended to limit applicant's protection in any way.

I claim:

1. A portable collapsible porch for use with campers, camping trailers and the like, comprising:

a platform structure having a top surface and a bottom surface and consisting substantially of:

a first rod having a left end and a right end;

a second rod having a left end and a right end oriented substantially parallel to said first rod;

a third rod having a first end pivotally attached to said left end of said first rod and a second end;

a fourth rod having a first end pivotally attached to said left end of said second rod and a second end pivotally attached to said second end of said third rod;

a fifth rod having a first end pivotally attached to said right end of said first rod and a second end, and a sixth rod having a first end pivotally attached to said right end of said second rod and a second end pivotally attached to said second end of said fifth rod, so that said platform structure folds into a compact substantially rectangular unit for storage;

a first leg attached to said platform structure near said left end of said first rod;

a second leg attached to said platform structure near said right end of said first rod;

a third leg attached to said platform structure near said left end of said second rod;

a fourth leg attached to said platform structure near said right end of said second rod;

a stairway structure attached to said platform structure, and a protective rail structure positioned above said top surface of said platform structure to ensure the safety of individuals using said portable collapsible porch.

2. The invention of claim 1, wherein said first, second, third and fourth legs are pivotally attached to said platform structure.

3. The invention of claim 2, wherein said first, second, third and fourth legs are attached to said bottom surface of said platform structure.

4. The invention of claim 1, including adjustment means for adjusting the length of said legs.

5. The invention of claim 2, including adjustment means for adjusting the length of said legs.

6. The invention of claim 3, including adjustment means for adjusting the length of said legs.

7. The invention of claim 1, wherein said stairway structure includes quick connect/disconnect means whereby said stairway structure is quickly attached to and detached from said platform structure.

8. The invention of claim 1, wherein said protective rail structure includes quick attaching means whereby said protective rail structure quickly attaches to and detaches from said platform structure.

9. The invention of claim 8, wherein said protective rail structure includes positioning means for adjusting the vertical position of said protective rail structure with respect to said platform structure.

10. A portable collapsible porch for use with campers, camping trailers and the like, comprising:

a platform structure having a top surface and a bottom surface and consisting substantially of:

a first rod having a left end and a right end;

a second rod having a left end and a right end oriented substantially parallel to said first rod;

a third rod having a first end pivotally attached to said left end of said first rod and a second end;

a fourth rod having a first end pivotally attached to said left end of said second rod and a second end pivotally attached to said second end of said third rod;

a fifth rod having a first end pivotally attached to said right end of said first rod and a second end, and a sixth rod having a first end pivotally attached to said right end of said second rod and a second end pivotally attached to said second end of said fifth rod, so that said platform structure folds into a compact substantially rectangular unit for storage;

a first leg attached to said platform structure near said left end of said first rod;

a second leg attached to said platform structure near said right end of said first rod;

a third leg attached to said platform structure near said left end of said second rod;

a fourth leg attached to said platform structure near said right end of said second rod;

a protective rail structure positioned above said top surface of said platform structure to ensure the safety of individuals using said portable collapsible porch, and a stairway structure attached to said protective rail structure.

* * * * *